US007000342B2

(12) United States Patent
Chen

(10) Patent No.: US 7,000,342 B2
(45) Date of Patent: Feb. 21, 2006

(54) STEAM IRON

(75) Inventor: Hsi-Fu Chen, Changhua (TW)

(73) Assignee: MITCO International Ltd., Taipei (TW)

( * ) Notice: Subject to any disclaimer, the term of this patent is extended or adjusted under 35 U.S.C. 154(b) by 173 days.

(21) Appl. No.: 10/762,310

(22) Filed: Jan. 23, 2004

(65) Prior Publication Data

US 2005/0160635 A1 Jul. 28, 2005

(51) Int. Cl.
*D06F 75/18* (2006.01)

(52) U.S. Cl. ..... 38/77.8

(58) Field of Classification Search ..... 38/77.8, 38/77.81, 77.82, 77.83, 77.6, 77.1; 239/124, 239/569; 137/217, 879, 901, 904; 251/11, 251/63, 366

See application file for complete search history.

(56) References Cited

U.S. PATENT DOCUMENTS 3,809,374 A * 5/1974 Schossow ..... 261/130
4,586,277 A * 5/1986 Reiss et al. ..... 38/77.81
5,209,407 A * 5/1993 Farrington ..... 239/491
6,318,009 B1 * 11/2001 De Maneville et al. ..... 38/77.8
6,622,404 B1 * 9/2003 Valiyambath ..... 38/96
6,745,504 B1 * 6/2004 Sastre et al. ..... 38/77.82

FOREIGN PATENT DOCUMENTS

GB 2217351 A * 10/1989

* cited by examiner

*Primary Examiner*—Ismael Izaguirre
(74) *Attorney, Agent, or Firm*—Browdy and Neimark, PLLC

(57) ABSTRACT

A steam iron includes a housing, a water tank and a boiler mounted in the housing, a water supply pipe for guiding water from the water tank to the boiler for boiling, a relief pipe connected between the boiler and the water tank for guiding steam from the boiler to the water tank when an internal pressure of the boiler is excessively high, a valve flap-operated one-way check valve mounted in the water supply pipe to let water pass from the water tank to the boiler and stop steam from pass through the water supply pipe to the water tank, and a piston-operated relief valve mounted in the relief pipe for enabling steam to pass to the water tank when the internal pressure of the boiler is excessively high.

8 Claims, 4 Drawing Sheets

STEAM IRON

BACKGROUND OF THE INVENTION

1. Field of the Invention

The present invention relates to steam irons and, more particularly, to such a steam iron, which prevents reverse flow of steam to the water tank through the water supply pipe of the water tank, and automatically discharges steam when the internal pressure of the boiler is excessively high.

2. Description of the Related Art

A regular steam iron generally comprises a housing, a water tank, and a boiler. The water tank is mounted in the housing and adapted to supply water to the boiler through a water supply pipe. The boiler is adapted to boil water into steam. This structure of steam iron is still not satisfactory in function. When the internal pressure of the boiler is excessively high, hot water (steam) will reversely pass through the water supply pipe to the water tank, increasing the internal pressure of the water tank and stopping the supply of water from the water tank to the boiler. The boiler may keep burning when dried. Burning dry may cause the boiler to burn out or to break the circuit.

SUMMARY OF THE INVENTION

It is therefore the main objective of the present invention to provide a steam iron, which prevents reverse flow of steam from the boiler to the water tank through the water supply pipe of the water tank.

It is another objective of the present invention to provide a steam iron, which automatically discharges steam from the boiler when the internal pressure of the boiler surpassed a predetermined level.

To achieve the above-mentioned objectives, the steam iron provided by the present invention comprises a housing having a receiving chamber therein, a water tank mounted in the receiving chamber and having a tank body for storing water and a water supply pipe extended from the tank body, a boiler mounted in said receiving chamber and having a boiler body connected to the water supply pipe for receiving water from the tank body and boiling water into steam and a relief pipe having an end connected to the boiler body and an opposite end connected to the tank body, a one-way check valve and a relief valve. The one-way check valve has a casing mounted in the water supply pipe and a valve flap movable in the casing of the one-way check valve between an open position and a close position. The valve flap is moved to the open position for enabling cold water to pass from the tank body to the boiler body when an internal pressure of the boiler body is within a predetermined level. The valve flap is moved to the close position by the internal pressure of the boiler body when the internal pressure of the boiler body surpassed the predetermined level. The relief valve has a casing mounted in the relief pipe and a piston mounted in the casing of the relief valve and movable between an open position and a close position to control passage of the relief pipe. The piston is moved to the open position for enabling steam to pass from the boiler body to the tank body when the internal pressure of the boiler body surpassed the predetermined level. The piston is moved to the close position by water from the tank body to stop the passage of the relief pipe when the internal pressure of the boiler body is below the predetermined level.

DETAILED DESCRIPTION OF THE INVENTION

Figure 1:
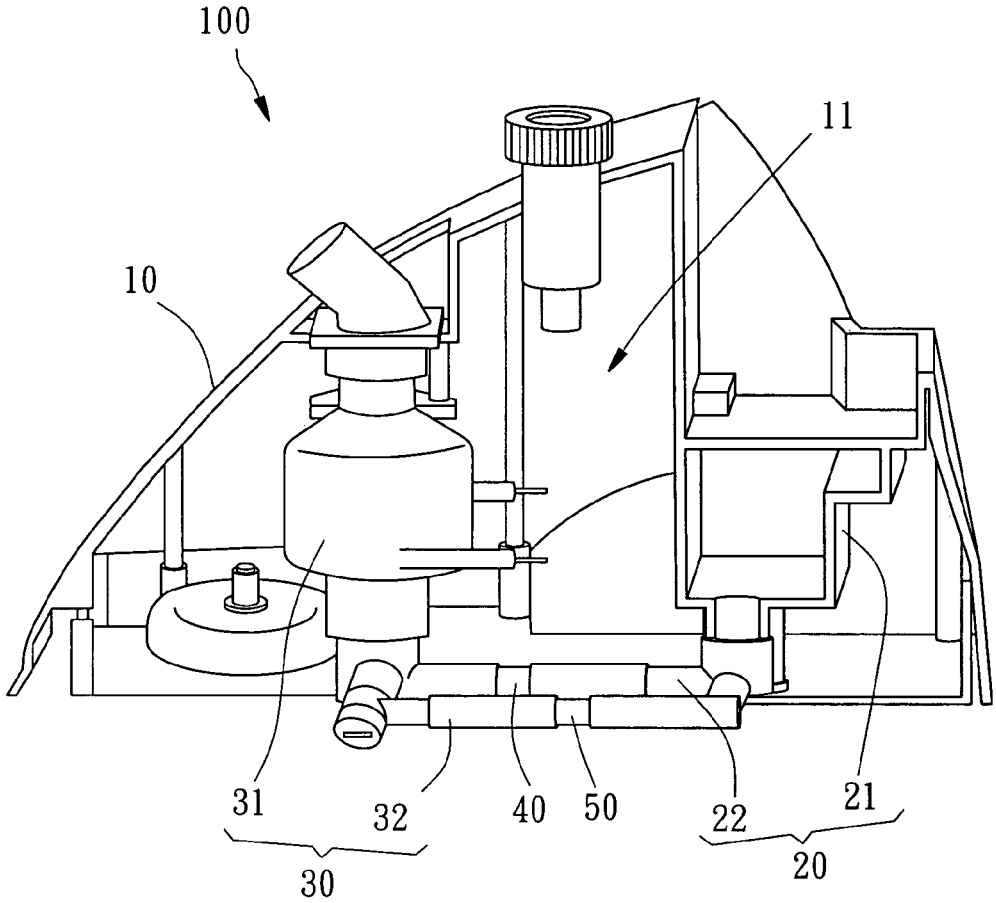
FIG. 1 is a schematic drawing of a steam iron according to the present invention.
Figure 2:
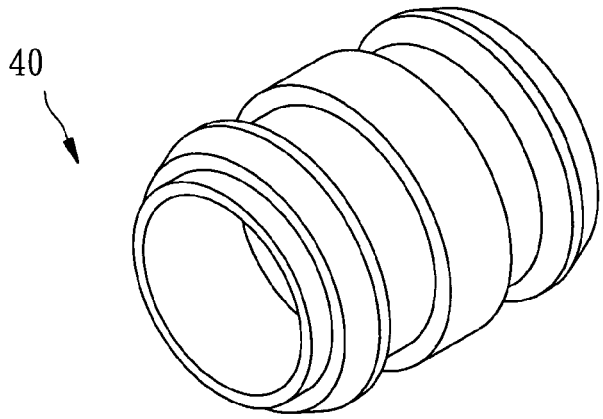
FIG. 2 is a perspective view of a one-way check valve for the steam iron according to the present invention.
Figure 3:
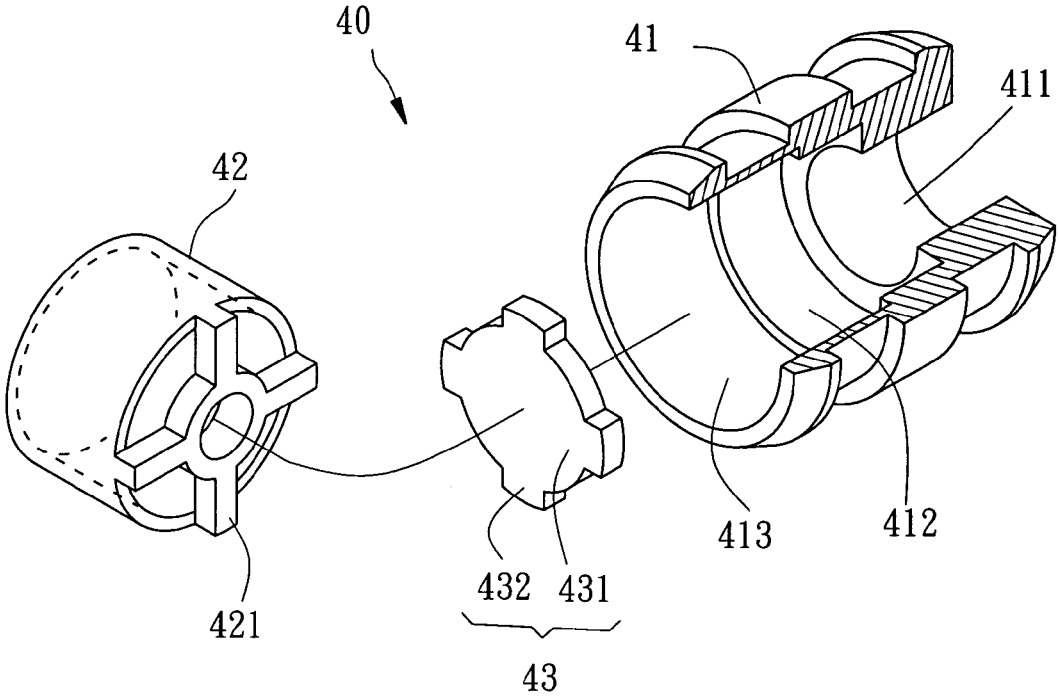
FIG. 3 is an exploded, partially sectional view of the one-way check valve shown in FIG. 2.
Figure 4:
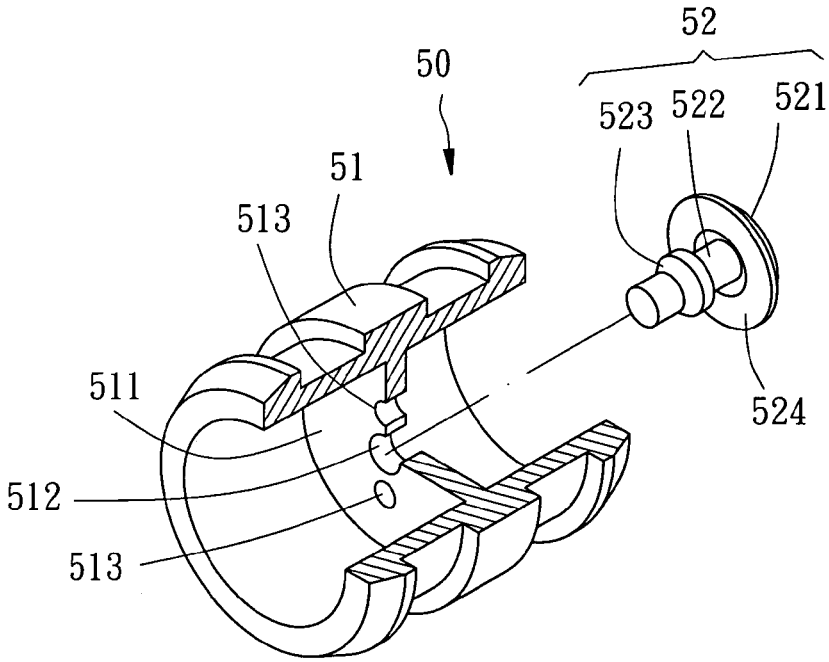
FIG. 4 is an exploded, partially sectional view of a relief valve for the steam iron according to the present invention.
Figure 5:
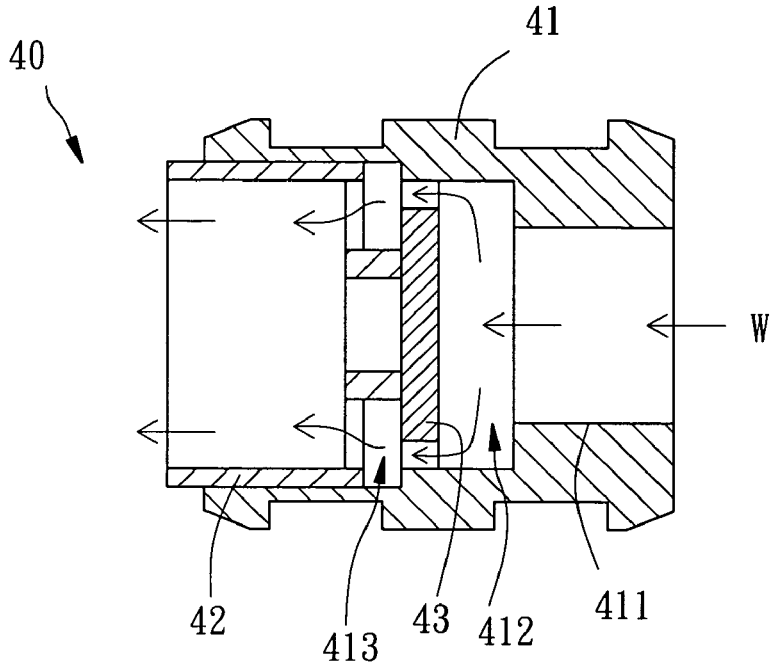
FIG. 5 is a schematic sectional view showing the open status of the one-way check valve according to the present invention.
Figure 6:
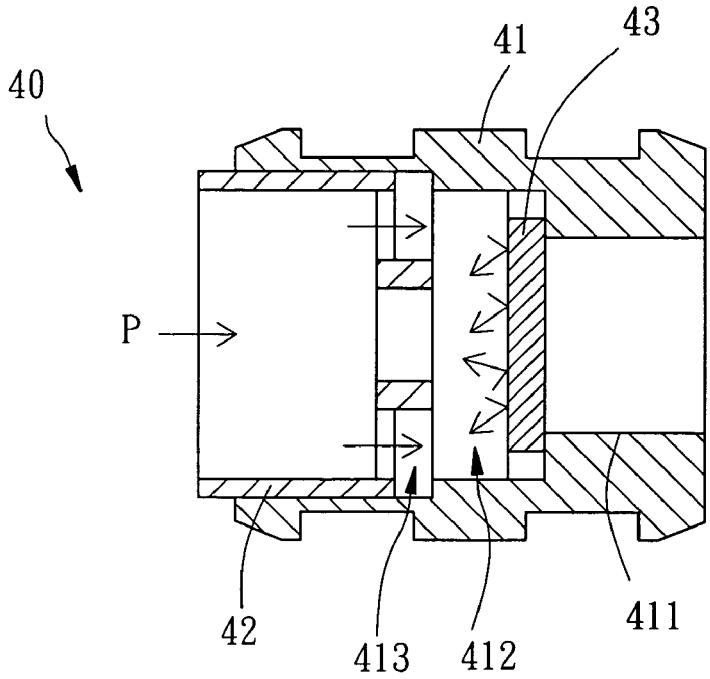
FIG. 6 is a schematic sectional view showing the close status of the one-way check valve according to the present invention.
Figure 7:
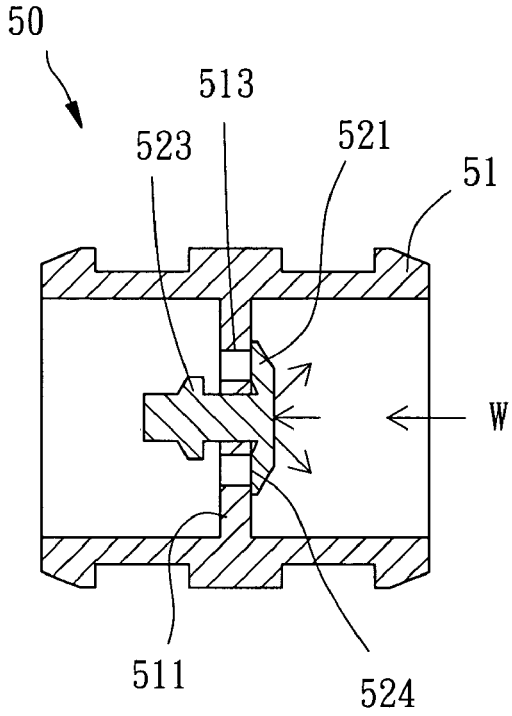
FIG. 7 is a schematic sectional view showing the close status of the relief valve according to the present invention.
Figure 8:
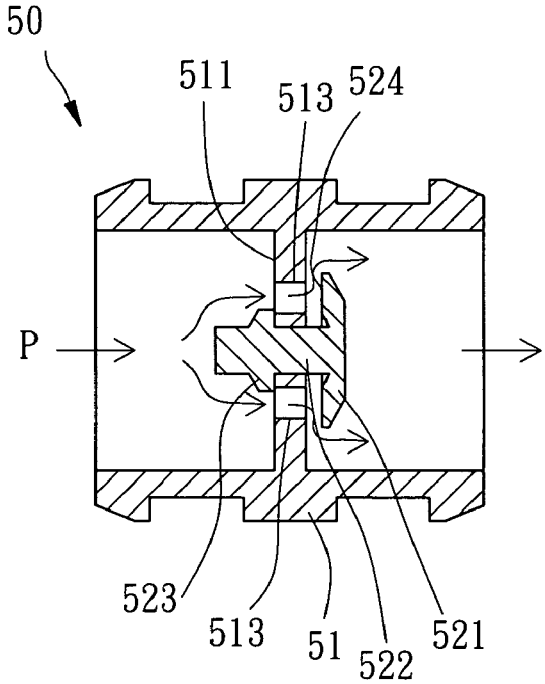
FIG. 8 is a schematic sectional view showing the open status of the relief valve according to the present invention.

Referring to FIGS. 1~8, a steam iron 100 in accordance with a preferred embodiment of the present invention is shown comprising a housing 10, a water tank 20, a boiler 30, a one-way check valve 40, and a high-pressure relief valve 50.

The housing 10 defines therein a receiving chamber 11, which accommodates the water tank 20, the boiler 30, the one-way check valve 40, and the relief valve 50.

The water tank 20 comprises a tank body 21 fixedly mounted inside the receiving chamber 11 of the housing 10 at one side, and a water supply tube 22 extended from the bottom side of the tank body 21 to the boiler 30.

The boiler 30 comprises a boiler body 31 and a relief pipe 32. The boiler body 31 is mounted inside the receiving chamber 11 of the housing 10 and connected to one end of the water supply tube 22 for receiving water from the water tank 20. The boiler 30 uses externally supplied electric energy to heat water into steam. The relief pipe 32 has one end connected to the boiler body 31, and the other end connected to the tank body 21.

The one-way check valve 40 is mounted in the water supply pipe 22 of the water tank 20 on the middle to guide water from the tank body 21 to the boiler 30, and to prevent reverse flow of water from the boiler 30 to the tank body 21. The one-way check valve 40 comprises a casing 41, a flow guide 42, and a valve flap 43. The casing 41 is a tubular member, comprising a water inlet 411 disposed at one end, a flow guide hole 413 disposed at the other end, and an actuation chamber 412 axially connected between the water inlet 411 and the flow guide hole 413. The water inlet 411 extends axially inwardly from one end of the casing 41 to a predetermined distance. The flow guide hole 413 extends axially inwardly from the other end of the casing 41 to a predetermined distance. The actuation chamber 412 is in fluid communication between the water inlet 411 and the flow guide hole 413. The actuation chamber 412 has an inner diameter greater than the water inlet 411 but smaller than the flow guide hole 413. The flow guide 42 is a tubular member having an outer diameter equal to the inner diameter of the flow guide hole 413. The two distal ends of the flow guide 42 are open ends. A grille 421 is provided at one end of the flow guide 42. The flow guide 42 is fitted into the flow guide hole 413 of the casing 41, keeping the grille 421 stopped at the stepped connection area between the actuation chamber 412 and the flow guide hole 413. The valve flap 43 is a disk-like member having a flap body 431 and a plurality of protruding stop portion 432 radially extended from the periphery of the valve flap body 431 and spaced from one another at distance. The diameter of the valve flap body 431 is greater than the water inlet 411. The valve flap 43 is mounted in actuation chamber 412, keeping the outer ends of the protruding stop portion 432 disposed in lightly contact with the peripheral wall of the actuation chamber 412.

The relief valve 50 is mounted in the relief pipe 32 of the boiler 30 on the middle, and adapted to release excessive high steam pressure from the boiler body 31. The relief valve 50 comprises a casing 51, and a piston 52. The casing 51 is a tubular member directly mounted in the relief pipe 32 on the middle, comprising a transversely extended stop wall 511, a center through hole 512 cut through the center of the stop wall 511, and a plurality of relief holes 513 cut through the stop wall 511 around the center through hole 512. The piston 52 is molded from elastic material, for example, rubber, comprising a piston rod 522 inserted through the center through hole 512 of the stop wall 511 of the casing 51, a piston head 521 provided at one end of the piston rod 522 and disposed at one side relative to the stop wall 511, and a stop flange 523 extended around the periphery of the piston rod 522 and disposed at the other side relative to the stop wall 511. The piston head 521 has a flat sealing face 524 adapted to seal the center through hole 512 and the relief holes 513, i.e., the area of the sealing face 524 of the piston head 521 is greater than the area covering the center through hole 512 and the relief holes 513. The outer diameter of the stop flange 523 is greater than the diameter of the center through hole 512.

After description of the parts of the steam iron 100 and their assembly procedure, the operation of the steam iron 100 is outlined hereinafter.

When the tank body 21 of the water tank 20 started to supply cold water W to the boiler body 31 of the boiler 30, cold water W is guided by the water supply pipe 22 to the one-way check valve 40 to push the valve flap 43 away from the water inlet 411 to the grille 421 of the flow guide 42 and then to flow through the open spaces in the grille 421 to the inside of the flow guide 42 (see FIG. 5) and then to the inside of the boiler body 31 for boiling into steam. When the internal pressure of the boiler body 31 surpassed a predetermined value, steam P will flow back to the inside of the water supply pipe 22 to push the valve flap 43 away from the grille 421 toward the water inlet 411, thereby causing the valve flap 43 to seal the water inlet 411, and therefore steam P is prohibited from returning to the tank body 21 through the water supply pipe 22 (see FIG. 6). At this time, steam P will flow to the relief pipe 32 to push the piston head 521 of the piston 52 away from the stop wall 511 and then to flow through the relief holes 513 to the inside of the tank body 21 (see FIG. 8), enabling the internal pressure of the boiler body 31 to be released.

Further, because steam P can be released from the boiler body 31 to the tank body 21 through the relief valve 50, cold water W can be continuously supplied from the tank body 21 to the boiler body 31, preventing burning of the boiler body 31.

If the steam pressure of the boiler body 31 is normal, the piston head 521 will be forced by cold water W from the container body 21 to the stop wall 511, causing the sealing face 524 to seal the center through hole 512 and the relief holes 513 (see FIG. 7) to stop cold water W from passing to the boiler body 31 through the relief pipe 32. If the internal pressure of the boiler body 31 is normal, steam pressure is insufficient to push the piston head 521 away from the stop wall 511, and therefore steam is prohibited from passing through the relief valve 50 to the tank body 21.

Further, because the relief holes 513 of the casing 51 of the relief valve 50 have a suitable diameter, releasing steam pressure does not cause a big amount of steam to flow to the inside of the tank body 21.

As indicated above, the steam iron uses a one-way check valve and a relief valve to control the internal pressure of the boiler body within a safety range, for enabling cold water to be continuously supplied to the boiler body to prevent burning dry.

Although a particular embodiment of the present invention has been shown and described, it will be understood that various modifications and changes could be made thereunto without departing from the spirit and scope of the invention.

What is claimed is:

1. A steam iron comprising:

a housing having a receiving chamber therein;

a water tank mounted in said receiving chamber, said water tank having a tank body for storing water, and a water supply pipe extended from said tank body;

a boiler mounted in said receiving chamber, said boiler having a boiler body connected to said water supply pipe for receiving water from said tank body and boiling water into steam, and a relief pipe having an end connected to said boiler body and an opposite end connected to said tank body;

a one-way check valve for controlling one-way flowing direction of water from said tank body to said boiler body, said one-way check valve having a casing mounted in said water supply pipe, and a valve flap movable in the casing of said one-way check valve between an open position and a close position, said valve flap being moved to said open position for enabling cold water to pass from said tank body to said boiler body when an internal pressure of said boiler body is within a predetermined level, said valve flap being moved to said close position by the internal pressure of said boiler body when the internal pressure of said boiler body surpassed the predetermined level; and a relief valve having a casing mounted in said relief pipe, and a piston mounted in the casing of said relief valve and movable between an open position and a close position to control passage of said relief pipe, said piston being moved to the open position for enabling steam to pass from said boiler body to said tank body when the internal pressure of said boiler body surpassed the predetermined level, said piston being moved to the close position by water from said tank body to stop the passage of said relief pipe when the internal pressure of said boiler body is below the predetermined level.

2. The steam iron as claimed in claim 1, wherein the casing of said one-way check valve comprises a water inlet disposed at an end thereof and connected to said tank body by said water supply pipe, a flow guide hole disposed at an opposite end thereof connected to said boiler body by said water supply pipe, and an actuation chamber axially connected between said water inlet and said flow guide hole, said actuation chamber having a diameter greater than said water inlet but smaller than said flow guide hole; wherein said valve flap is mounted in said actuation chamber and moved between the close position to seal said water inlet and the open position away from said water inlet for enabling water to pass from said tank body through said water inlet and said flow guide hole to said boiler body.

3. The steam iron as claimed in claim 2, wherein said one-way check valve further comprises a flow guide mounted in said flow guide hole for supporting said valve flap in the open position for enabling water to pass from said water inlet through said actuating chamber to said flow guide hole and then said boiler body.

4. The steam iron as claimed in claim 3, wherein said valve flap comprises a flap body and a plurality of protruding stop portions radially extended from a periphery of said flap body and disposed in lightly contact with a peripheral wall of said actuation chamber, said flap body having a diameter greater than said water inlet, said flap body sealing said water inlet when said valve flap moved to the close position; said flow guide is a tubular member comprising a grille disposed at an end for supporting said valve flap in the open position for enabling water to pass through open spaces in said grille to said boiler body.

5. The steam iron as claimed in claim 1, wherein the casing of said relief valve comprises a transverse stop wall that stops the passage of said relief pipe, a center through hole cut through said transverse stop wall, and a plurality of relief holes cut through said transverse stop wall around said center through hole; said piston comprises a piston rod inserted through the center through hole of the casing of said relief valve, a piston head disposed at an end of said piston rod, and a stop flange extended around said piston rod, said piston head being attached to said stop wall to seal the center through hole and the relief holes of the casing of said relief valve and to further close the passage of said relief valve when said piston is moved to the close position, said piston head being moved away from said stop wall and said stop flange being stopped at said stop wall for enabling steam to pass from said boiler body through said relief valve to said tank body when said piston is moved to the open position.

6. The steam iron as claimed in claim 5, wherein said valve flap is made of elastic material.

7. The steam iron as claimed in claim 5, wherein said piston head has a flat sealing face disposed at one side facing said stop wall for sealing said center through hole and said relief holes.

8. The steam iron as claimed in claim 7, wherein said piston rod of said piston is movable in said center through hole within a distance equal to the distance between said flat sealing face of said piston head and said stop flange.

* * * * *